US006484465B2

(12) United States Patent
Higgins

(10) Patent No.: US 6,484,465 B2
(45) **Date of Patent: *Nov. 26, 2002**

(54) OPEN JOINT WALL PANEL SYSTEM

(75) Inventor: Wes J. Higgins, Marathon, WI (US)

(73) Assignee: Architectural Facades, Inc., Frazer, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/460,510

(22) Filed: Dec. 14, 1999

(65) Prior Publication Data

US 2002/0124514 A1 Sep. 12, 2002

(51) Int. Cl.[7] ..... E04B 2/90

(52) U.S. Cl. ..... 52/474; 52/478; 52/235; 52/506; 52/506.1; 52/521; 52/529; 52/531; 52/539; 52/544; 52/395

(58) Field of Search ..... 52/474, 478, 235, 52/506.01, 506, 521, 529, 531, 539, 395, 544

(56) References Cited

U.S. PATENT DOCUMENTS

| | | | |
|---|---|---|---|
| 3,898,780 | A | 8/1975 | Beer |
| 4,840,004 | A | 6/1989 | Ting |
| 4,924,647 | A | 5/1990 | Drucker |
| 5,154,029 | A | 10/1992 | Sturgeon |
| 5,452,552 | A | 9/1995 | Ting |
| 5,598,671 | A | 2/1997 | Ting |

*Primary Examiner*—Carl D. Friedman
*Assistant Examiner*—Christy M. Green
(74) *Attorney, Agent, or Firm*—Blank Rome Comisky & McCauley LLP

(57) ABSTRACT

The open joint wall panel system includes panels having a standardized shape attached to an extrudable track that, in turn, is attached to an exterior wall. Each panel is vertically positioned using dead load anchors and positioned relative to the exterior wall with anchor clips.

14 Claims, 5 Drawing Sheets

OPEN JOINT WALL PANEL SYSTEM

BACKGROUND OF THE INVENTION

1. Field of the Invention

This invention relates to open joint wall panel systems. In particular, this invention relates to an open joint rain screen wall panel system that does not require wet sealant and that uses an anchoring guttering system with standardized metal panels.

2. Description of Related Art

Some conventional rain screen wall panel systems require frequent maintenance. These rain screen systems use wet sealants that have been applied either at the manufacturing facility or in the field. The sealants prevent the ingress of water between the panels of the wall system. However, these wet sealants degrade over time due to exposure to the elements. Degradation of these sealants mars the appearance of the building. Therefore, conventional wall systems require frequent maintenance of the sealants to avoid excessive degradation by replacing old sealant with fresh sealant.

Wet sealants also restrict the ability of associated metal panels to move in response to temperature and pressure differentials between the exterior and interior surfaces of the panels. If the panels are restricted and exposed to thermal fluctuations, the panels may warp, "oil-can"or develop kinks in the surface.

A conventional rain screen system 10 that does not use a wet sealant is shown in FIG. 1. This system 10 has brackets 12 attached to an exterior wall 14 of a building. The brackets 12 support a vertical track 16. The vertical track includes pins 18. Panels 20 of the system 10 include hooks 22 that each receive an isolator 24 and which engage a corresponding pin 18. The system 10 is difficult to install because each pin 18 must be precisely vertically positioned to align with a corresponding hook 22. The pins 18 are also difficult to manufacture.

SUMMARY OF THE INVENTION

The present invention provides an open joint, back-ventilated rain screen panel system that uses dead load anchors, anchor clips and a track system. The panel system of the present invention does not require wet sealants and, therefore, avoids the necessity for regular maintenance. An exemplary embodiment of the panel system of the present invention uses standardized metal panels that are anchored by a guttering system. The system of the present invention permits movement of the panels in response to temperature changes. An exemplary embodiment of the panel system of the present invention uses nylon anchor blocks which minimize the friction between the individual wall panels and the track and enable the use of differing panel materials.

The panel system of the present invention does not use the difficult and restrictive hook and pin design of some conventional panel systems. The panel system of the present invention allows for much quicker installation and also reduces the number of penetrations of the wall of the building in comparison to conventional panel systems.

BRIEF DESCRIPTION OF THE DRAWINGS

The preferred embodiments of this invention will be described in detail, with reference to the following figures, wherein.

These and other features and advantages of this invention are described in or are apparent from the following detailed description of the preferred embodiments.

DETAILED DESCRIPTION OF THE PREFERRED EMBODIMENTS

Figure 1:
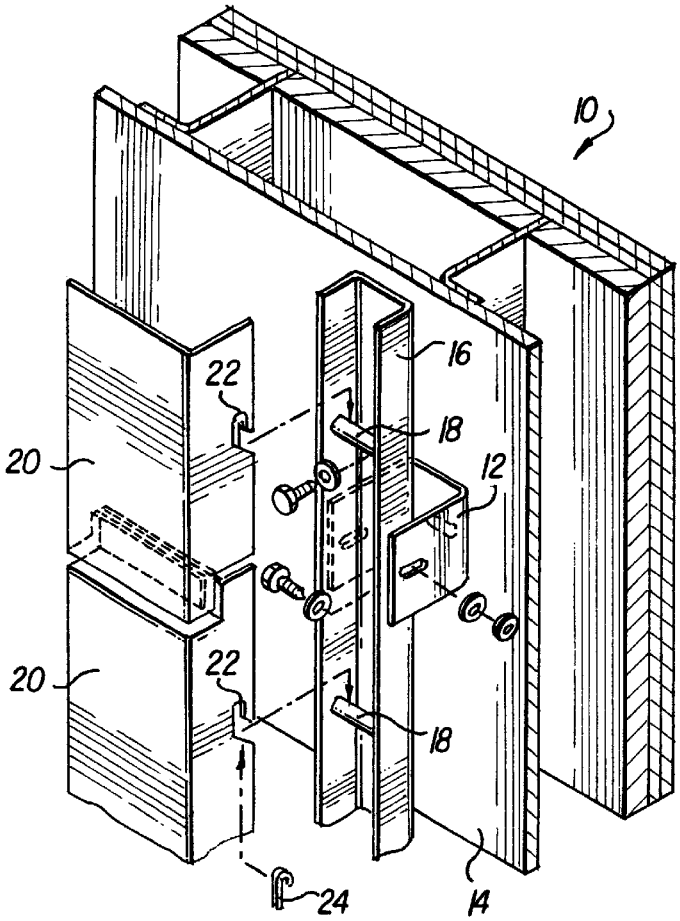
FIG. 1 (PRIOR ART)
FIG. 1 is an exploded perspective view of a conventional wall panel system.
Figure 2:
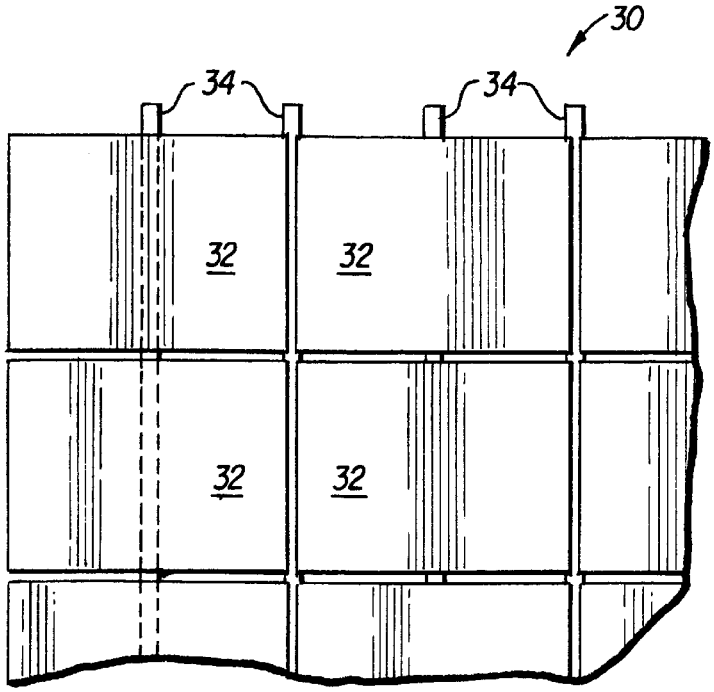
FIG. 2 is an elevation view of an exemplary embodiment of an open joint wall panel system in accordance with the present invention.

FIG. 2 shows an elevation view of an open joint wall panel system 30 in accordance with the present invention. The system 30 includes panels 32 and tracks 34. The tracks 34 are attached to a wall of a building (not shown) and the panels 32 are attached to the tracks 34 in accordance with the method described below.

Figure 3:
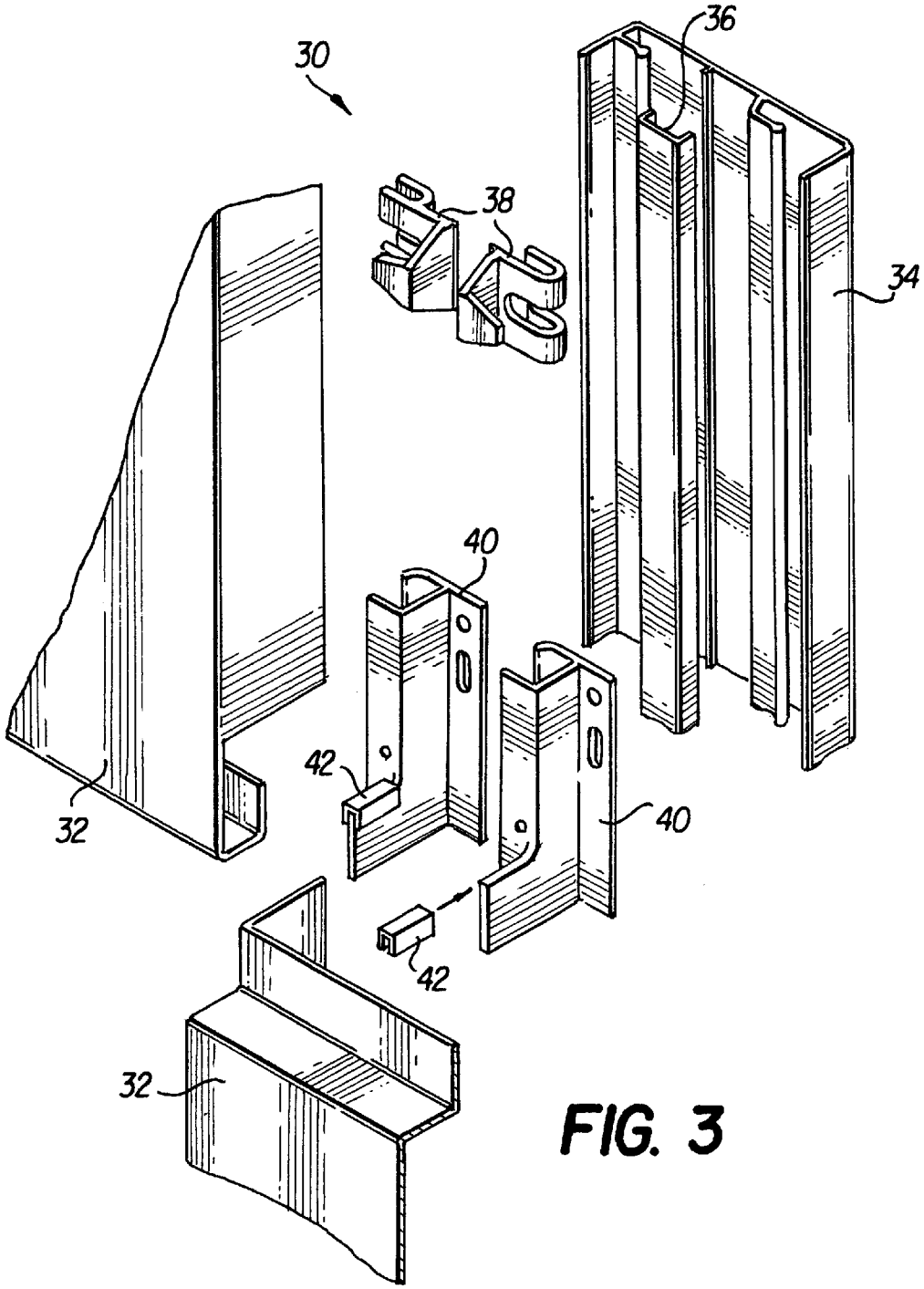
FIG. 3 is an exploded perspective view of the open joint wall panel system of FIG. 2.

FIG. 3 shows an exploded perspective view of the open joint wall panel system 30 of FIG. 2. The system 30 includes an extruded aluminum track 34 attached to a wall (not shown), an extruded aluminum snap-on cover 36, a pair of anchor clips 38 and a pair of dead load anchors 40 with isolators 42. As shown more clearly in FIGS. 4 and 5, the track 34 is substantially gutter-shaped with a back portion 44 and side walls 46 and 48 and serves to, not only fasten the panels 32 to the wall, but also to direct water away from the building. The left side wall 46 of the track 34 includes a protruding flange 50. The protruding flange 50 includes a bulbous end 52. The bulbous end 52 engages a U-shaped channel 54 in an anchor clip 38. Similarly, the back wall 44 includes a protrusion 56 that extends substantially perpendicularly from the back wall 44, turns to be substantially parallel to the back wall 44 and ends in a bulbous end 58. The bulbous end 58 engages a U-shaped channel 60 in an anchor clip 38. In this manner, the anchor clips 38 engage the track 34 and prevent the panels 32 from moving toward or away from the track 34. However, the anchor clips 38 permit the panels 32 to move substantially parallel to the back wall 44 of the track 34 and to rotate about the bulbous ends, 52 and 58, to permit a curved exterior wall.

Figure 4:
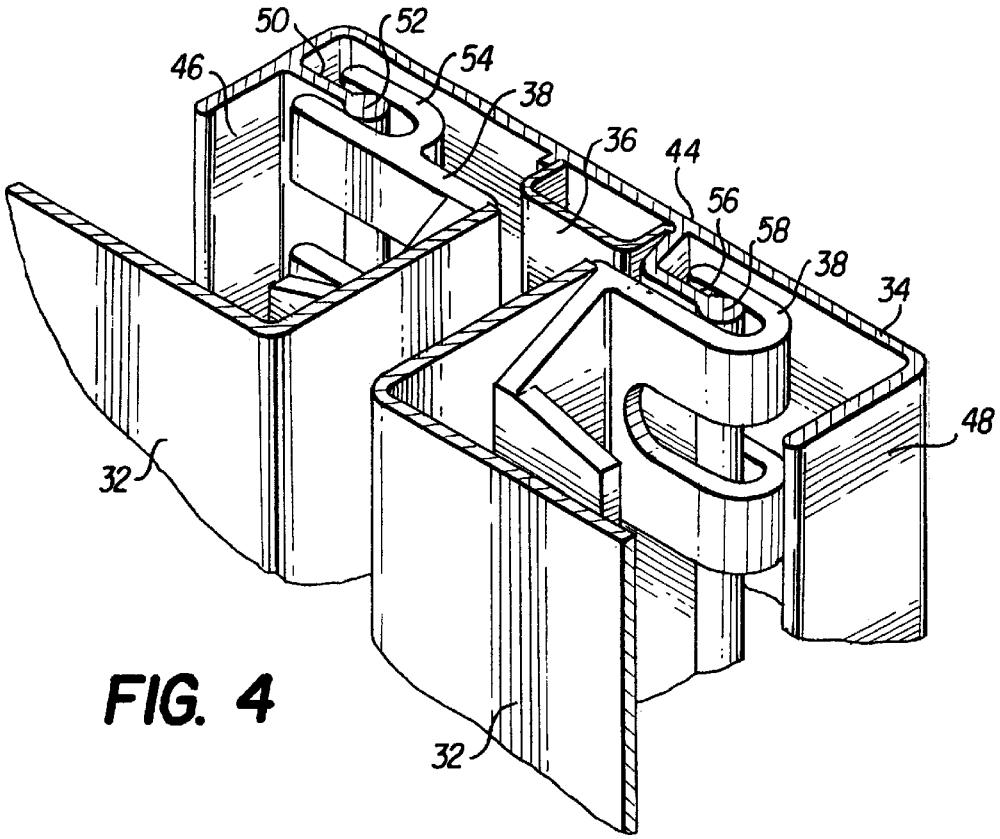
FIG. 4 is a perspective sectional view of the open joint wall panel system of FIG. 2 showing anchor clips anchoring panels to a track.
Figure 5:
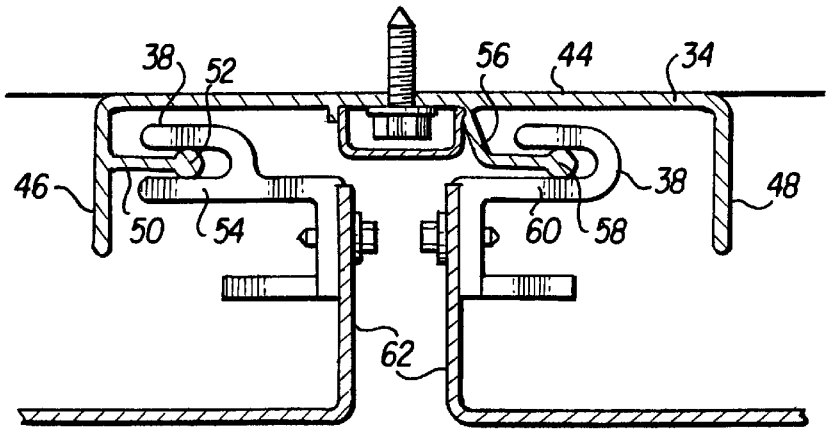
FIG. 5 is a plan view of the sectional view of the embodiment of FIG. 4.
Figure 6:
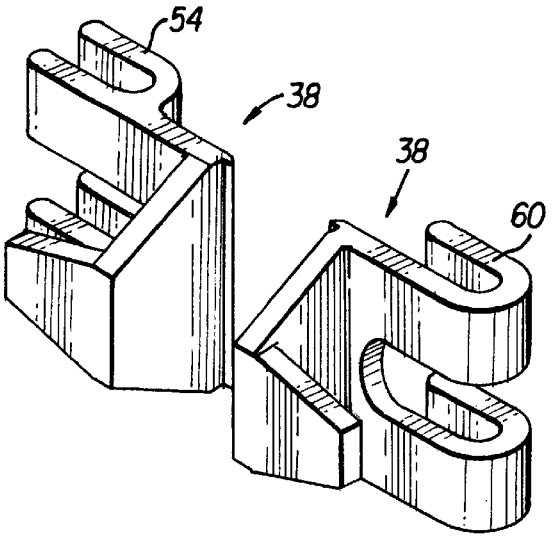
FIG. 6 is a perspective view of the anchor clips of FIG. 4.

The anchor clips 38 of the exemplary embodiment shown in FIGS. 4–6 are made of molded fiberglass reinforced nylon. Therefore, these anchor clips 38 are compatible with a wide range of materials. The anchor clips 38 also provide a low friction engagement between the track 34 and the panel 32 to permit easy installation and to prevent oil-canning, snapping and popping due to thermal stresses. Each of the panels 32 have side flanges 62 that are connected to the anchor clips 38 with conventional fasteners. The anchor clips 38 may be installed onto side flanges 62 of the panels 32 at the factory or at the building site. The anchor clips 38 are generally attached to the side walls, 46 and 48, approximately every 16 inches and are attached to the side walls, 46 and 48, by rivets or screws that extend through pre-punched holes. The anchor clips 38 make it easy to install the panels 34 because the anchor clips 38 do not need to be precisely vertically aligned with anything on the track.

The panels 32 have a very simple design and are, therefore, very simple to fabricate. The panels 32 have simple, straight side walls 62, top walls 64 and flanges 66 (shown in FIG. 10). There is no need to manufacture panels with hooks that require precise alignment with corresponding pins.

Figure 7:
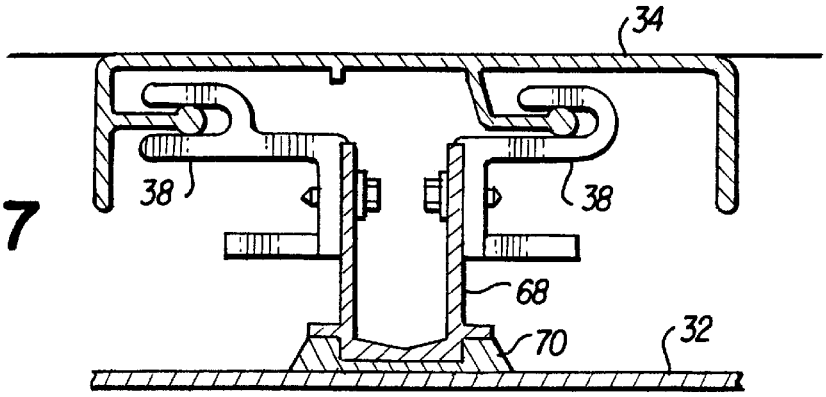
FIG. 7 is a sectional view of an exemplary embodiment of a wall panel stiffener in accordance with the present invention.

FIG. 7 shows a horizontal cross-section of the panel 32 with a panel stiffener 68 in accordance with an exemplary embodiment of the present invention. The panel 32 includes an extruded aluminum U-shaped stiffener 68 attached to the panel 32 using an adhesive 70 such as an adhesive tape or the like. The stiffener 68 connects to the anchor clips 38 which are, in turn, connected to the track 34. In this manner, the panel stiffener 68, of the panel system may strengthen each panel 32 and fortify its attachment to the exterior wall.

Figure 8:
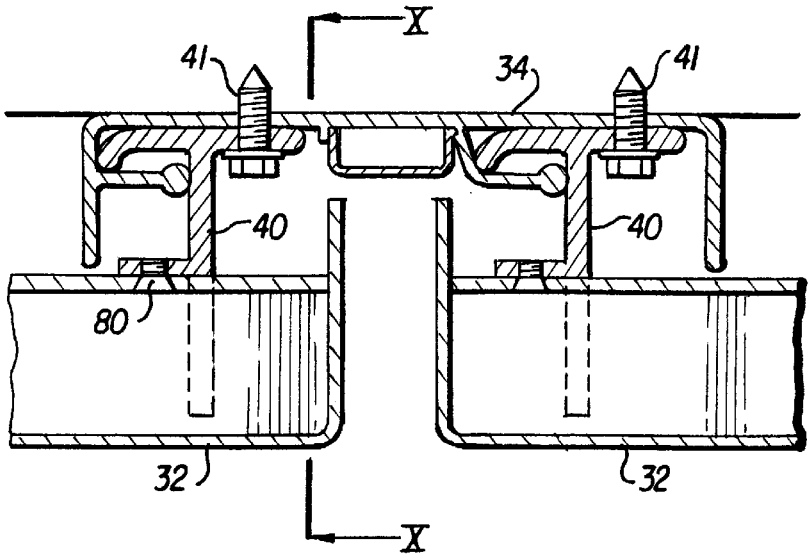
FIG. 8 is a sectional view of an exemplary embodiment of a dead load anchor in accordance with the present invention.

FIG. 8 shows another horizontal cross-section of the panel system in accordance with the present invention. The cross section of FIG. 8 is taken at the top of the panels 32 to show their vertical connection to the exterior surface of the building. The panel system includes structural aluminum dead load anchors 40 that are attached to the track 32 using fasteners 41.

Figure 10:
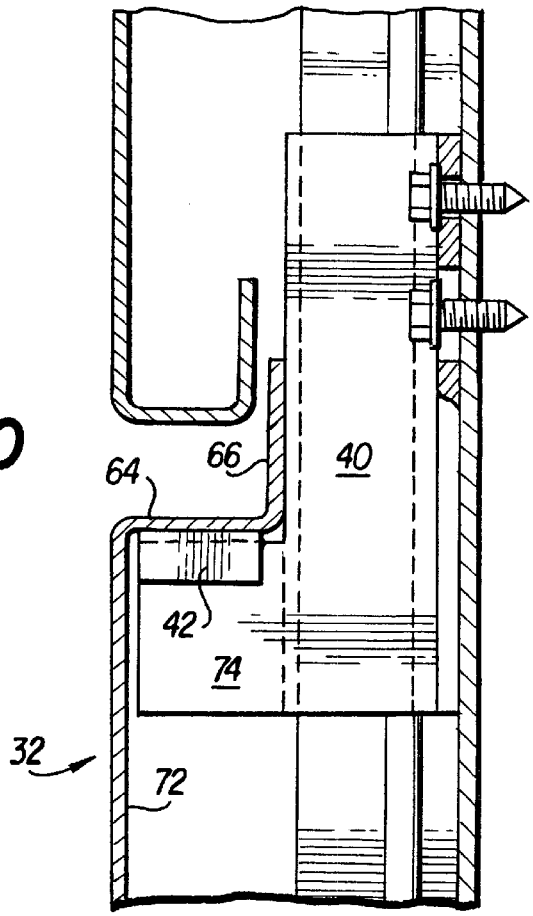
FIG. 10 is a sectional view taken along line X—X of FIG. 8.

FIGS. 8 and 10 shows how the dead load anchor 40 supports a panel 32. The panel 32 includes a top wall 64 that extends horizontally from the forward vertical surface 72 of the panel 32. The top wall 64 has an upwardly extending flange 66. The top wall 64 rests on a plastic isolator 42 which is fitted onto an outwardly extending leg 74 of the anchor 40. In this manner, the outwardly extending leg 74 of the anchor 40 vertically positions the panel 32.

Figure 9:
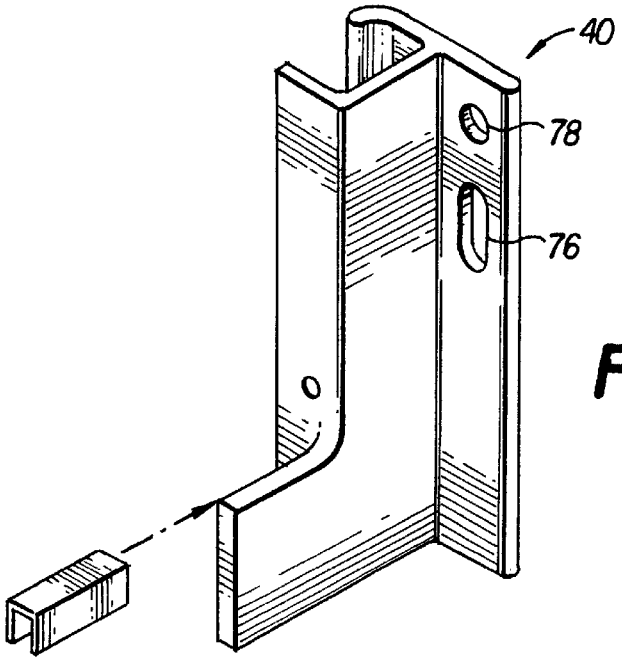
FIG. 9 is a perspective view of the dead load anchor and isolator of FIG. 8.

As shown in FIG. 9, the anchor 40 includes a slot 76 and a hole 78. The anchor 40 and panel 32 are positioned and aligned using a fastener in the slot 76. Then, after the panel 32 is leveled and the anchor 40 is precisely positioned, the anchor 40 is fixed into position using another fastener in hole 78.

As shown in FIG. 8, the panel 32 is fastened to one of-the anchors 40 with an anti-walk fastener 80. The anti-walk fastener 80 prevents the panel 32 from moving side-to-side due to thermal expansion or other forces. The panel 32 is free to expand and contract relative to all other contacts with the exterior wall. However, while the panel 32 is freely moveable to prevent thermal stress, the panel 32 is constrained to remain fastened to the exterior wall.

The panel system of the present invention is easily maintainable because each panel 32 may be removed by simply removing the anti-walk fastener 80, sliding the anchor clips 38 off of the protrusions, 50 and 56, and then rotating the upwardly extending flange 66 from under any panel 32 that may be disposed above the panel 32 being removed. Maintenance may then be performed on the exterior wall. The panel 32 may be installed very simply by reversing this process.

The present invention has many advantages over previous rain screen systems. For example, the rain screen system of the present invention is capable of handling many different types of materials including dissimilar materials. For instance, each panel 32 may consist of a material that is incompatible with the track 34. In other words, should a panel of a first material such as copper be in contact with an anchor of a second material such as aluminum, one or the other will corrode through a process called galvanic corrosion. The present invention attaches the panels 32 to the track 34 using reinforced nylon anchors, 38 and 40, that isolate the dissimilar materials from each other to prevent galvanic corrosion. Additionally, the panel system of the present invention is capable of handling panels of different thicknesses and coatings.

The components of the panel system are also easily manufactured. The track may be extruded into its final form. The track does not require further modifications, such as the addition of pins or the like. The panels are simple structures that can be standardized. The panels do not require the addition of hooks or the like. Rather, the panels may be easily installed by attaching anchor clips to the panels, attaching dead load anchors to the track and assembling the wall system.

While this invention has been described in conjunction with the specific embodiments outlined above, it is evident that many alternatives, modifications and variations are apparent to those skilled in the art. Accordingly, the preferred embodiments of the invention as set forth above are intended to be illustrative and not limiting. Various changes may be made without departing from the spirit and scope of the invention.

What is claimed is:

1. A wall panel system comprising:

at least two tracks fastened to a wall, each track including a back wall, a left wall and a right wall, a first protruding flange extending from said left wall, and a second protruding flange extending from said back wall;

at least one panel having left, right and top side walls;

a left anchor clip attached to said left side wall of said panel and engaging said second protruding flange; and a dead load anchor attached to one of said tracks and supporting said top surface of said panel, wherein at least one of said front protruding flange and said second protruding flange has a spheric-like shaped end.

2. The system of claim 1, wherein said track is substantially u-shaped.

3. The system of claim 1, further comprising a snap-on cover that covers fasteners that fasten at least one of said tracks to said wall.

4. The system of claim 1, wherein said left and right anchor clips comprise a non-metallic material.

5. The system of claim 4, wherein said non-metallic material is molded fiberglass reinforce nylon.

6. The system of claim 1, wherein each of said tracks comprise extruded material.

7. The system of claim 6, wherein said material is aluminum.

8. The system of claim 1, wherein said first protruding flange is substantially parallel to said back wall.

9. The system of claim 1, wherein said second protruding flange extends substantially perpendicularly to said back wall, curves and further extends substantially parallel to said back wall.

10. The system of claim 1, further comprising a track support for each of said tracks.

11. The system of claim 1, wherein said left anchor clip engages said second protruding flange with a U-shaped channel.

12. The system of claim 1, wherein said right anchor clip engages said first protruding flange with a U-shaped channel.

13. The system of claim 1, further comprising:

a third track-fastened to said wall; and a stiffener attached to said panel and connected to a second left anchor clip and a second right anchor clip, wherein said second left anchor clip is attached to a left side wall of said stiffener and engaging a first protruding flange of said third track and said right anchor clip is attached to said right side wall of said stiffener and engaging a second protruding flange of said third track.

14. The system of claim 1, wherein said dead load anchor is substantially L-shaped.

* * * * *